US008479335B1

(12) United States Patent
Perry

(10) Patent No.: US 8,479,335 B1
(45) Date of Patent: Jul. 9, 2013

(54) KNEE SUPPORT

(75) Inventor: Donald Franklin Perry, Coaldale (CA)

(73) Assignee: Perry Kneelers, Inc., Coaldale, CA (US)

( * ) Notice: Subject to any disclaimer, the term of this patent is extended or adjusted under 35 U.S.C. 154(b) by 0 days.

(21) Appl. No.: 13/480,404

(22) Filed: May 24, 2012

(51) Int. Cl.
*A47C 7/50* (2006.01)
*A47C 16/04* (2006.01)

(52) U.S. Cl.
USPC ..... 5/657; 5/648; 297/423.16

(58) Field of Classification Search
USPC ..... 5/657, 652, 648, 624, 621, 640, 630; 297/423.1, 423.11, 423.12, 423.14–423.16, 297/423.39–423.46, 187
See application file for complete search history.

(56) References Cited

U.S. PATENT DOCUMENTS

| | | | | |
|---|---|---|---|---|
| 530,859 | A * | 12/1894 | Shults | 297/423.42 |
| 1,409,746 | A * | 3/1922 | McCord | 248/166 |
| 2,528,331 | A * | 10/1950 | Bell | 297/423.46 |
| 2,798,732 | A | 7/1957 | Graig | |
| 2,983,309 | A * | 5/1961 | Brantl | 297/423.42 |
| 3,563,605 | A * | 2/1971 | Pinkas | 297/423.43 |
| 3,656,809 | A | 4/1972 | Ronning | |
| 4,394,049 | A | 7/1983 | Ward | |
| 4,764,756 | A | 8/1988 | Horan | |
| 6,926,365 | B2 | 8/2005 | Bottoms | |
| 7,080,715 | B1 | 7/2006 | Bowlin | |
| 7,086,702 | B1 | 8/2006 | Hurt | |
| 7,878,513 | B2 | 2/2011 | Damouzehtash | |
| 2004/0201268 | A1 * | 10/2004 | Liao | 297/423.11 |
| 2006/0082206 | A1 * | 4/2006 | Travis | 297/423.11 |

FOREIGN PATENT DOCUMENTS

| | | |
|---|---|---|
| CN | 2377917 | 5/2000 |
| GB | 2452334 | 3/2009 |

* cited by examiner

*Primary Examiner* — Robert G Santos
(74) *Attorney, Agent, or Firm* — Richard Okimaw

(57) ABSTRACT

An apparatus for supporting a user comprising a platform extending between first and second edges each having two corners, a frame having four substantially parallel uprights located proximate to each of the first and second edges of the platform, each of said uprights slidably locating said platform proximate to a corner of said platform and an elastic support member extending between each of the first and second edges of the platform and the frame so as suspend the platform from the frame. The platform is biased from a first position located proximate to a ground surface to a second position vertically spaced above the first position by the elastic support members, wherein said first and second positions are substantially parallel to each other.

9 Claims, 6 Drawing Sheets

KNEE SUPPORT

BACKGROUND OF THE INVENTION

1. Field of Invention

The present invention relates to support devices in general and in particular to a method and apparatus for supporting and assisting a user to get into and out of a kneeling position.

2. Description of Related Art

Kneeling is a position which is frequently difficult or uncomfortable for many people. Many people have difficulty with the act of getting into and staying in a kneeling position. In particular, many people find remaining in a kneeling position to be hard on the outer surface of their knees. This is particularly the case where the person is kneeling on rough or hard surfaces.

A further difficulty many people experience is the act of lowering themselves into a kneeling position from a standing position. It will also be appreciated that the movement of returning to standing from a kneeling position is likewise similarly difficult for such people. Such movements may be difficult for people either due to reduced muscular strength or due to injury or weakness within their knees themselves. For other people, the movement into and out of a kneeling position places a painful level of strain on their back.

Previous attempts have been made to provide knee supports for a user so as to reduce the difficulty required to get into and out of as well as remain in a kneeling position. Some attempts have been made to provide a padded surface on which the user may kneel. Such devices have located such surface at a fixed position which does not however aided the user in getting into and out of the kneeling position. Examples of such devices may be found in U.S. Pat. No. 4,763,756 issued Aug. 16, 1988 to Horan.

SUMMARY OF THE INVENTION

According to a first embodiment of the present invention there is disclosed an apparatus for supporting a user comprising a platform extending between first and second edges each having two corners, a frame having four substantially parallel uprights located proximate to each of the first and second edges of the platform, each of said uprights slidably locating said platform proximate to a corner of said platform and an elastic support member extending between each of the first and second edges of the platform and the frame so as suspend the platform from the frame. The platform is biased from a first position located proximate to a ground surface to a second position vertically spaced above the first position by the elastic support members, wherein said first and second positions are substantially parallel to each other.

The platform may be substantially rectangular. The platform may have two corners defining each of the first and second edges. The platform may include padded sections. The elastic support members may extend between the two corners defining the first and second edges over the frame. The elastic support members may provide an upward biasing force to the platform of between 10 and 200 pounds force.

The frame may comprise a pair of spaced apart inverted loops with the platform therebetween. The corners of the platform may be slidably supported by the frame. The elastic support members are contained within hollow sections of the frame.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
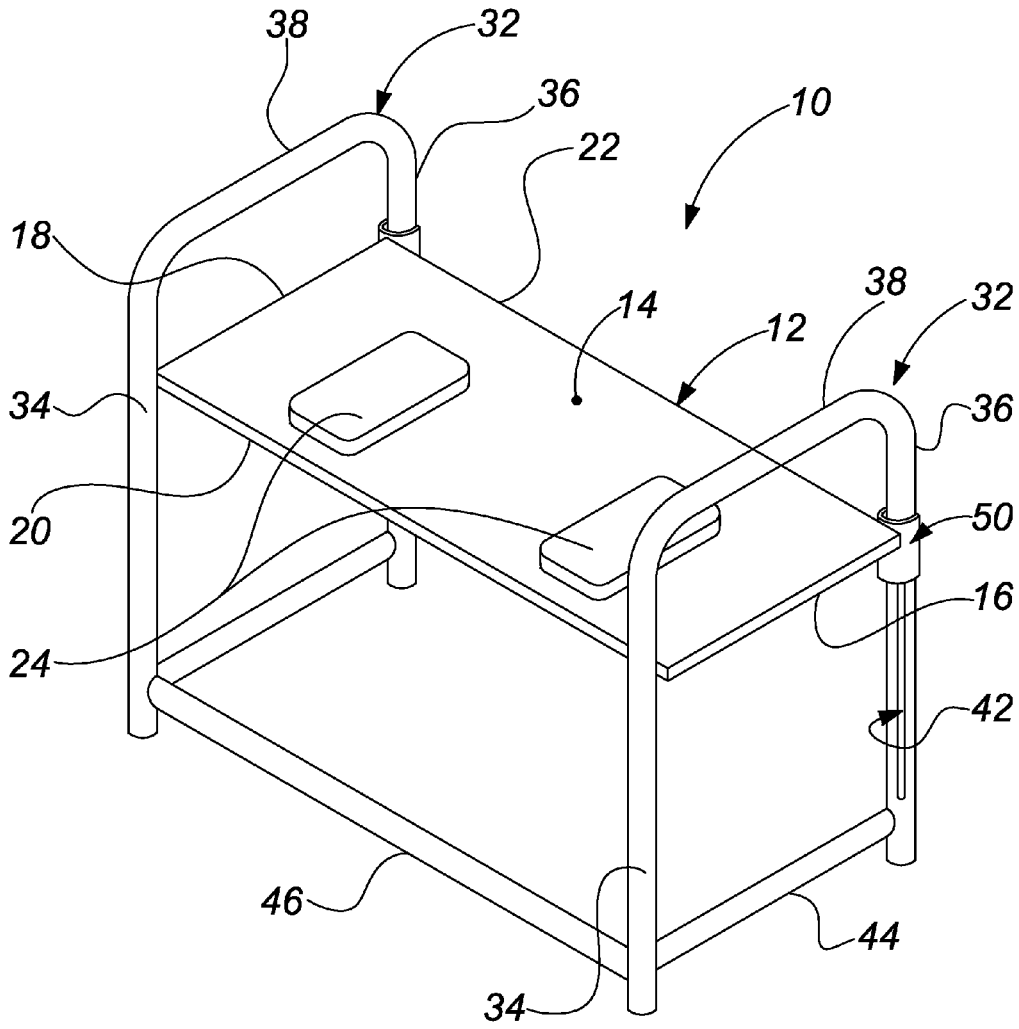
FIG. 1 is a perspective view of an apparatus for supporting a user in a kneeling position according to a first embodiment of the present invention.

Referring to FIG. 1, an apparatus for supporting the knees of a user according to a first embodiment of the invention is shown generally at 10. The apparatus comprises a platform 12 slidably supported within a frame 30 and having a top surface 14 to receive and support the knees of a user thereon. The platform 12 is moveable between lowered and raised positions and is biased by a biasing element to the raised position as will be more fully described below.

The platform 12 extends between first and second side edges, 16 and 18, respectively and front and rear edges 20 and 22, respectively. The platform 12 may optionally include padded portions 24 on the top surface 14 thereof sized and positioned to receive the knees of a user thereon which may comprise a portion or the entire top surface of the platform. The platform 12 may be substantially rectangular as illustrated or any other suitable outline, such as, by way of non-limiting example, square, oval, circular, octagonal, hexagonal or irregular. The platform may be formed of any suitable material, such as, by way of non-limiting example wood, metal, plastic or composite materials and may have a thickness sufficient to support the weight of the user thereon. The platform 12 will further have a size selected to be able to receive a user thereon while permitting such a user to grasp the top portions of the frame for support. In practice, it has been found that a width of between 6 and 12 inches (152 and 305 mm) and a length of between 18 and 30 inches (457 and 762 mm) has been useful although it will be appreciated that other dimensions for the platform may be useful as well. The platform 12 may be angularly oriented, by an angle, generally indicated at 25 such that the front edge 20 is higher than the rear edge 22. The angle 25 assists in providing a more comfortable position for the user and may be selected to be any angle between 0 and 30 degrees.

Figure 2:
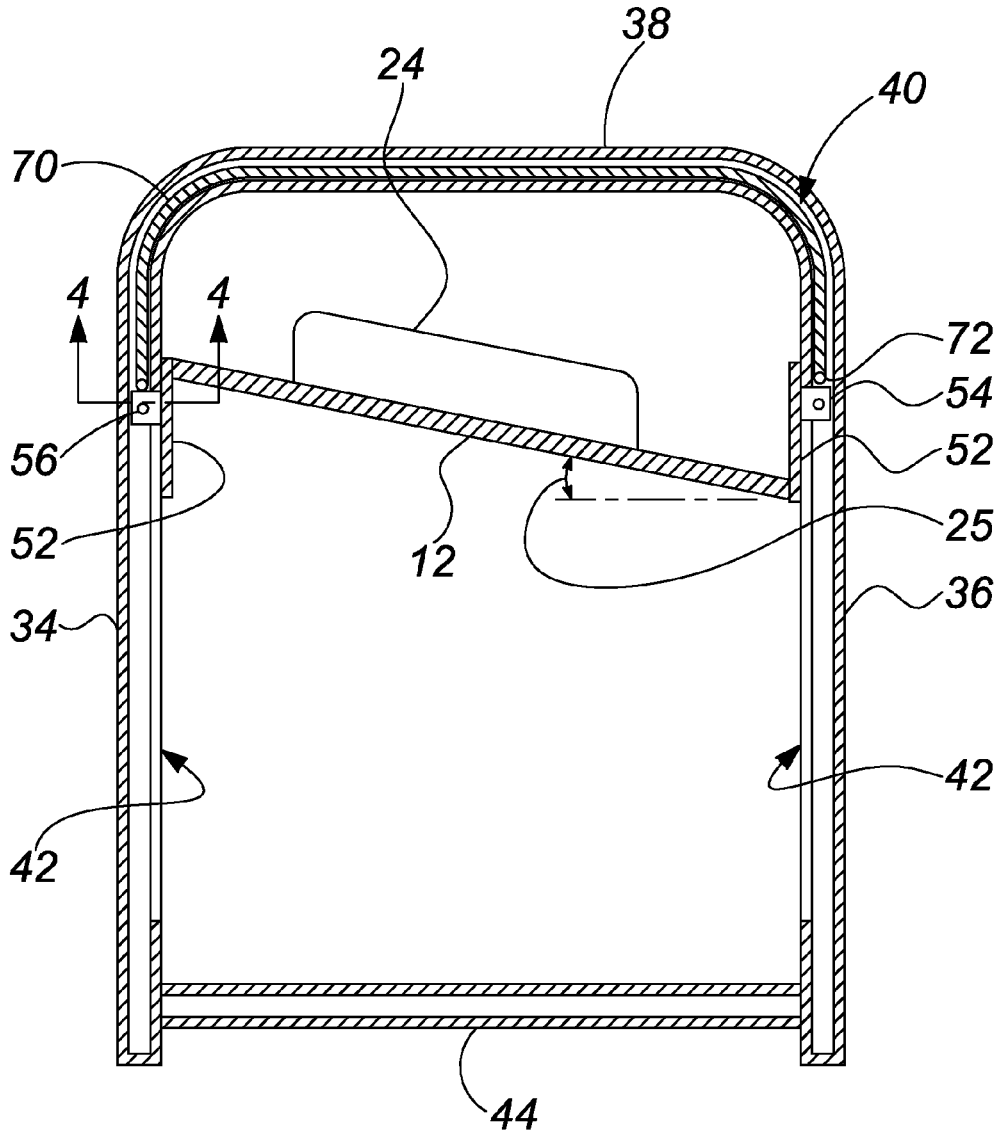
FIG. 2 is a cross-sectional view of the apparatus of FIG. 1 as taken along the line 3-3 at the first position.
Figure 3:
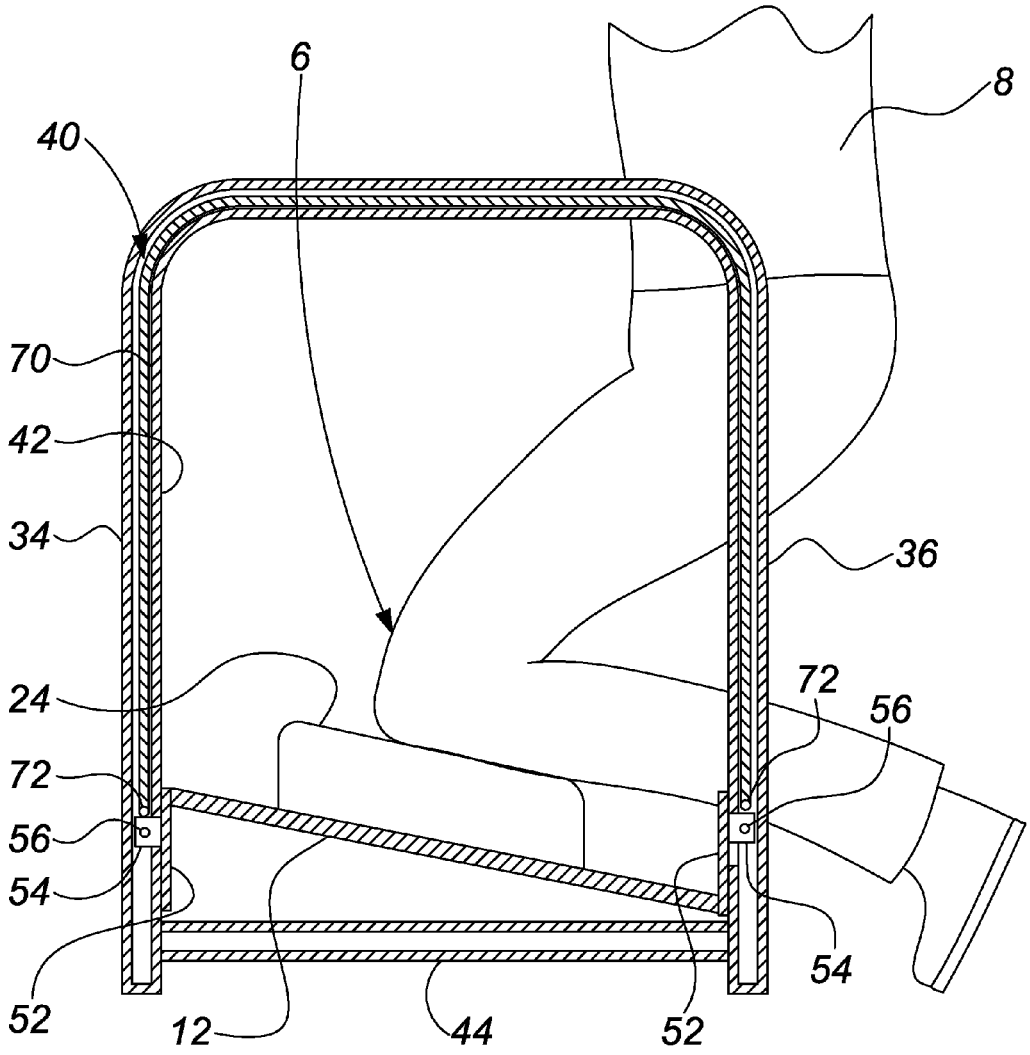
FIG. 3 is a cross-sectional view of the apparatus of FIG. 1 as taken along the line 3-3 at the second position.

The frame 30 comprises a pair of parallel space spaced apart inverted u-shaped members 32 each comprising front and rear uprights, 34 and 36, respectively with a top connecting portion 38 between the top ends thereof. As illustrated in FIGS. 2 and 3, the front and rear uprights 34 and 36 and the top connecting portions 38 may be formed of substantially tubular members with a common cavity 40 therein the purpose of which will be more fully described below. As illustrated the front and rear uprights 34 and 36 and the top connecting portions 38 may be substantially tubular, although it will be appreciated that other cross-sectional shapes may be useful as well, such as, by way of non-limiting example, square, oval, rectangular, or irregular. The front and rear uprights 34 and 36 are substantially parallel to each other so as to support the platform therebetween at a plurality of locations therealong. Each of the front and rear uprights 34 and 36 includes a longitudinal slot therealong at a position opposite to the other of the front or rear uprights. Optionally, the frame may include bottom braces 44 extending between bottom portions of the front and rear uprights and a front brace 46 extending between the two u-shaped members 32 to provide additional stability to the apparatus. Furthermore, the frame 30 may optionally include selectably connectable extensions extending from the bottom end thereof so as to permit a user to adjust the height of the apparatus 10 as are commonly known in the art. The front and rear uprights 34 and 36 will be selected to have a height sufficient to position the top connecting portion 38 at a height that may be grasped by a user. In practice it has been found that a height of between 18 and 30 inches (457 and 762 mm) has been useful although it will be appreciated that other heights dimensions may be useful as well. The frame 30 may be formed of any suitable material, such as, by way of non-limiting example, metal, wood, plastic, or composite materials.

Figure 4:
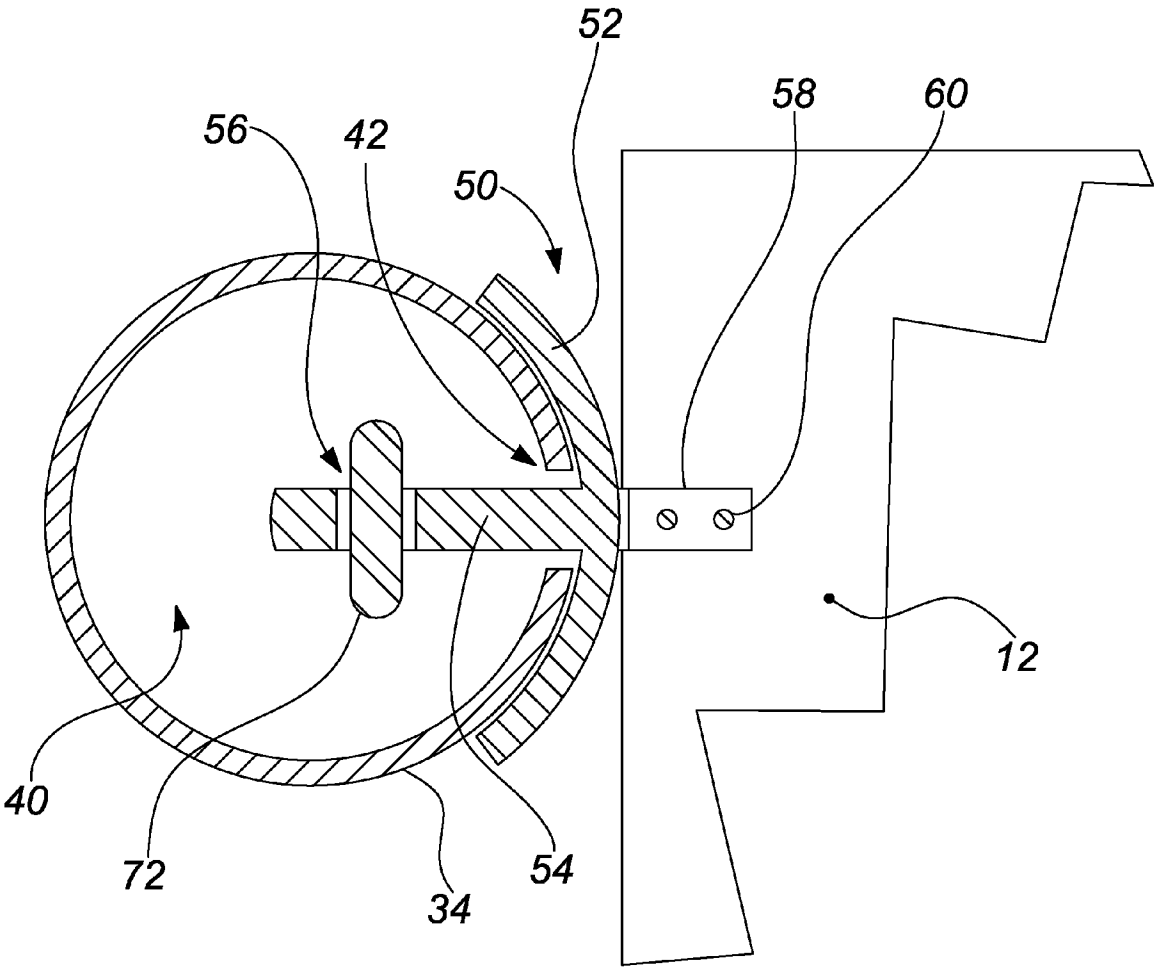
FIG. 4 is a detailed view of one of the sliding assemblies of the apparatus of FIG. 1.

Each slot 42 includes a support sleeve 50 associated therewith for supporting a corner of the platform 12. With reference to FIG. 4, each support sleeve 50 comprises a semi-circular plate 52 having a tab 54 extending radially therefrom. As illustrated, the semi-circular plate 52 may have a shape selected to correspond to the outer surface of the upright 34 so as to be maintainable closely thereto. The tab 54 extends radially inwardly from the semi-circular plate and has a thickness sufficient to be received within the slot 42 of the upright 34. The tab 54 includes a mounting bore 56 therethrough or other suitable fastening means so as to be securable to an elastic member as will be more fully described below. The support sleeve 50 may further include a mounting bracket 58 or other suitable means for securing the support sleeve 50 to the platform 12 by means of fasteners 60 or the like. The support sleeves 50 may be formed of any suitable material, such as, by way of non-limiting example, metal, plastic or composite materials.

With reference to FIGS. 2 and 3, the apparatus further includes an elastic member 70 extending through the cavities 40 of the u-shaped members 32 between tabs 54. The elastic member 70 is securable to the bores 56 of each tab 54 or securable to the support sleeve 50 by any other suitable means. The elastic member 70 is selected to have a length sufficient to extend between the tabs 54 in their raised position as illustrated in FIG. 2. The elastic member 70 has sufficient elasticity to permit the platform 12 and the support sleeves 50 to a position proximate to the bottom of the front and rear uprights 34 and 36 as illustrated in FIG. 3 under the weight of a user 8. When the user 8 is removed from the platform 12, the elastic members 70 bias the platform 12 and support sleeves 50 to the topmost position illustrated in FIG. 2. Although only one elastic member 70 is illustrated in FIGS. 2 and 3, it will be appreciated that each u-shaped member 32 will include at least one elastic member so as to bias and lift both sides of the platform 12. The elastic members 70 may be selected to provide a biasing force based upon the intended user and the amount of assistance required by such person to return to a standing position. In practice, it has been found that elastic members providing between 10 and 200 pounds of lift to the platform will be sufficient although other biasing forces will be useful as well. The elastic member 70 may be formed of a material selected from natural and synthetic rubbers, springs or any other suitable biasing members. Although the elastic members 70 are illustrated as being tied to the tab 54 by knots 72, it will be appreciated that any other suitable fastening means may also be utilized.

Figure 5:
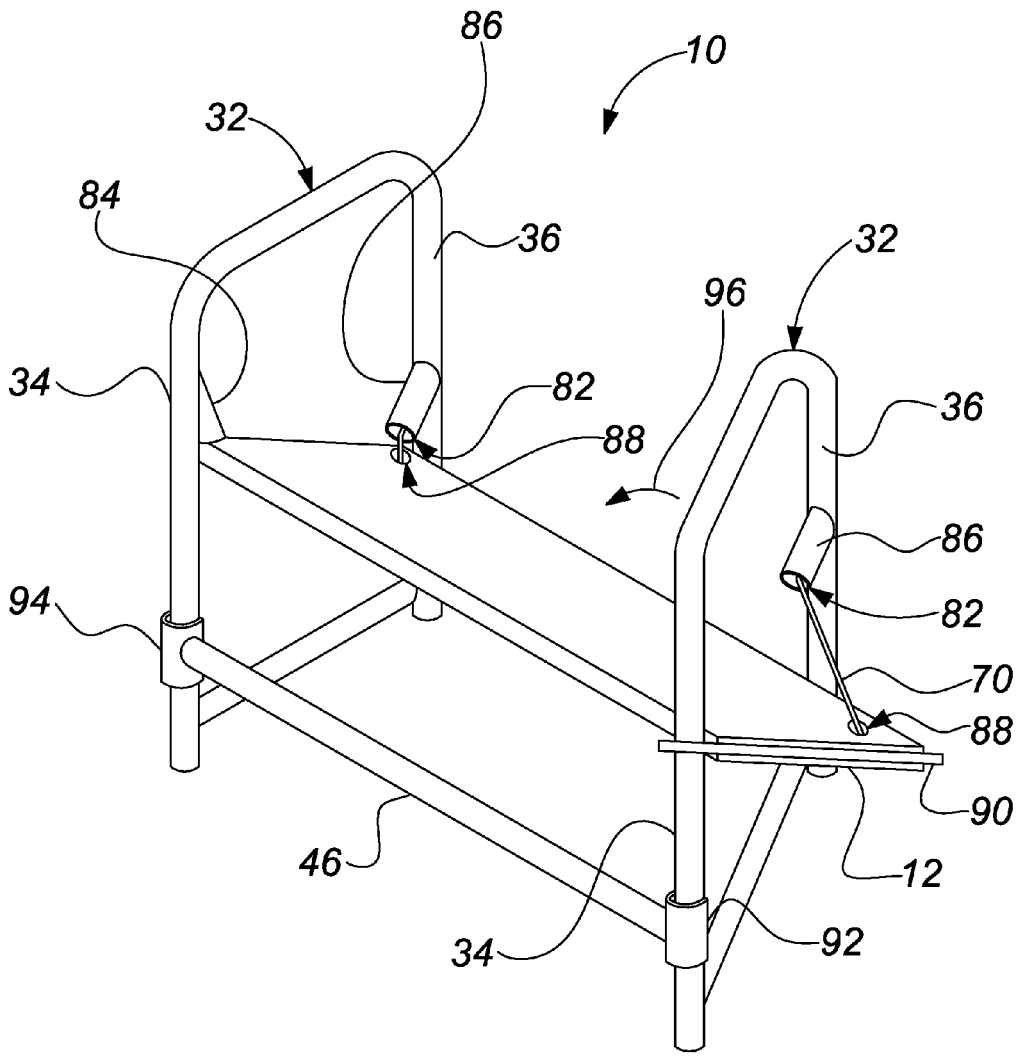
FIG. 5 is a perspective view of an apparatus for supporting a user in a kneeling position according to a further embodiment of the present invention.
Figure 6:
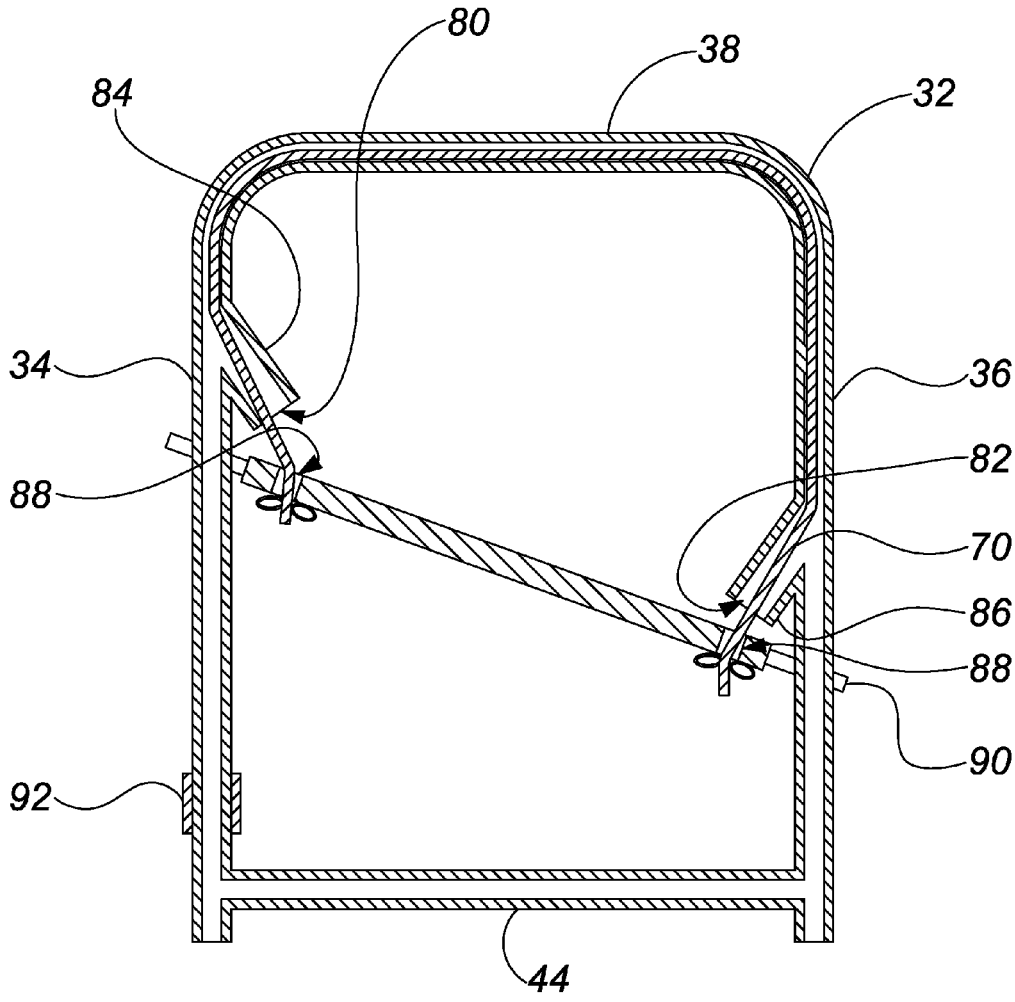
FIG. 6 is a cross-sectional view of the apparatus of FIG. 5 as taken along the line 6-6.

In operation, a user approaches the apparatus from the rear and places their knees 6 upon the pads 24. The user then permits their weight to press the platform downward to the position illustrated in FIG. 3 which may be utilized for working in any location for which kneeling is required. When the user is competed with their kneeling task, they may slowly stand up such that the elastic members 70 urge the platform to the topmost position shown in FIG. 2 and thereby assisting the user in standing. Optionally, the use may grasp the top connecting portions 38 of the u-shaped members to provide them with additional stability during such movements With reference to FIGS. 5 and 6, a further embodiment of the present invention is illustrated. As illustrated, the u-shaped members 32 of the frame 30 may include front and rear ports, 80 and 82, respectively. The front and rear ports may be formed in angled portions, 84 and 86, respectively extending towards each other from the front and rear uprights 34 and 36. The elastic member 70 is adapted to be passed through the front and rear ports 80 and 82 so as to suspend the platform 12 therefrom. The platform 12 may include bores 88 proximate to the corners thereof through which the elastic members 70 may be secured by way of tying, fasteners, adhesives or the like. As illustrated in FIGS. 5 and 6, the platform 12 may also include retaining extensions 90 extending therefrom so as to retain the platform 12 between the u-shaped members 32.

With reference to FIGS. 5 and 6, the front brace 46 may extend between first and second collars 92 and 94, respectively surrounding a portion of the front uprights 34. The first and second collars 92 and 94 may be rotatable around the front uprights so as to permit the u-shaped members 32 to be rotated relative thereto in a direction generally indicated at 96. It will be appreciated that such rotation will permit the apparatus 10 to be folded substantially flat for ease of storage and transportation. It will be appreciated that the frame 30 may be useful for hanging other objects, such as, by way of non-limiting example, tool trays or holders as are commonly known in the art.

While specific embodiments of the invention have been described and illustrated, such embodiments should be considered illustrative of the invention only and not as limiting the invention as construed in accordance with the accompanying claims.

What is claimed is:

1. An apparatus for supporting a user comprising:

a platform extending between first and second edges each edge having two corners;

a frame having four substantially parallel uprights located proximate to each of said first and second edges of said platform, each of said uprights slidably locating said platform proximate to a corner of said platform; and an elastic support member extending between each of said first and second edges of said platform and said frame so as suspend said platform from said frame, wherein said platform is biased from a first position located proximate to a ground surface to a second position vertically spaced above said first position by said elastic support members, wherein said first and second positions are substantially parallel to each other.

2. The apparatus of claim 1 wherein said platform is substantially rectangular.

3. The apparatus of claim 2 wherein said platform has two corners defining each of said first and second edges.

4. The apparatus of claim 1 wherein said platform includes padded sections.

5. The apparatus of claim 3 wherein said elastic support members extend between said two corners defining said first and second edges over said frame.

6. The apparatus of claim 5 wherein said elastic support members provide an upward biasing force to said platform of between 10 and 200 pounds force.

7. The apparatus of claim 3 wherein said frame comprises a pair of spaced apart inverted u-shaped members with said platform therebetween.

8. The apparatus of claim 7 wherein said elastic support members are contained within hollow sections of said frame.

9. The apparatus of claim 7 wherein u-shaped members include top connecting portions operable to be grasped by a user.

* * * * *